US012007155B2

(12) United States Patent
Li

(10) Patent No.: US 12,007,155 B2
(45) Date of Patent: Jun. 11, 2024

(54) ICE CUBE TRAY BOX FOR FACILITATING ICE MAKING AND ICE REMOVING

(71) Applicant: Jian Li, Zhejiang (CN)

(72) Inventor: Jian Li, Zhejiang (CN)

( * ) Notice: Subject to any disclaimer, the term of this patent is extended or adjusted under 35 U.S.C. 154(b) by 308 days.

(21) Appl. No.: 17/702,800

(22) Filed: Mar. 24, 2022

(65) Prior Publication Data

US 2022/0235990 A1 Jul. 28, 2022

(30) Foreign Application Priority Data

Jan. 25, 2021 (CN) ..... 202120199065.9

(51) Int. Cl.
*F25C 1/24* (2018.01)

(52) U.S. Cl.
CPC ..... *F25C 1/24* (2013.01); *F25C 2400/06* (2013.01)

(58) Field of Classification Search
CPC ..... F25C 1/24; F25C 2400/06
See application file for complete search history.

(56) References Cited

U.S. PATENT DOCUMENTS 2,168,739 A * 8/1939 Miner ..... F25C 1/24 249/69
D992,606 S * 7/2023 Wu ..... D15/90
2012/0055188 A1* 3/2012 Levie ..... F25C 1/24 249/70

* cited by examiner

*Primary Examiner* — James Sanders
(74) *Attorney, Agent, or Firm* — JCIPRNET

(57) ABSTRACT

An ice cube tray box for facilitating ice making and ice removing, which includes a box body, a cover body arranged at an open end of the box body, and an ice cube tray body arranged inside the box body, wherein a vertical upward rib assembly is arranged on an inner wall of the box body, a notch assembly matched with the rib assembly in use is arranged on an outer edge of the ice cube tray body, an ice removing plate for facilitating ice removing is clamped and arranged on the inner side of the cover body, and ice knocking columns are integrally arranged on the ice removing plate.

10 Claims, 2 Drawing Sheets

ICE CUBE TRAY BOX FOR FACILITATING ICE MAKING AND ICE REMOVING

CROSS-REFERENCE TO RELATED APPLICATION

This application claims the priority benefit of China application serial no. 202120199065.9, filed on Jan. 25, 2021. The entirety of the above-mentioned patent application is hereby incorporated by reference herein and made a part of this specification.

FIELD OF TECHNOLOGY

The present invention belongs to the technical field of daily necessities, in particular to an ice cube tray box for facilitating ice making and ice removing.

BACKGROUND

In daily life, refrigerators are often used to make ice cubes with application of ice cube trays. Traditional ice cube tray structures are relatively simple. Most of them are composed of a plurality of concave grids arranged in rows and columns. During ice making, cold water is added to an ice cube tray. Then the ice cube tray is put into a freezer room of the refrigerator for freezing and icing. Because the volume of water will expand after freezing, it is usually difficult to take out ice cubes. In order to take out ice cubes conveniently, the existing ice cube trays usually use soft materials at the bottom of the ice cube trays. When ice cubes are taken out, they need to be pressed one by one and only one can be taken out at a time. Moreover, the ice cube tray of this structure needs to be pressed frequently, which will lead to the damage of the bottom of the ice cube tray and reduce the service life.

SUMMARY

Aiming at the problems existing in the prior art, the design of the present invention aims at providing an ice cube tray box for facilitating ice making and ice removing.

The present invention is realized by the following technical scheme:

The present invention relates to an ice cube tray box for facilitating ice making and ice removing, which includes a box body, a cover body arranged at an open end of the box body, and an ice cube tray body arranged inside the box body, wherein a vertical upward rib assembly is arranged on an inner wall of the box body, a notch assembly matched with the rib assembly in use is arranged on an outer edge of the ice cube tray body, an ice removing plate for facilitating ice removing is clamped and arranged on an inner side surface of the cover body, and ice knocking columns are integrally arranged on the ice removing plate.

Further, the box body is rectangular as a whole, short sides thereof are arranged in an arc shape, and the rib assembly includes long side ribs and short side ribs with the same structure.

Further, the long side ribs include two central ribs and two first end ribs, the central ribs are symmetrically arranged at center positions of the long sides of the box body, the first end ribs are respectively arranged at end positions of the long sides of the box body, and the two first end ribs are diagonally arranged.

Further, the short side ribs include two second end ribs, the two second end ribs are respectively arranged on inner sides of the short sides of the box body and are arranged far away from the side where the first end ribs are located, and the two second end ribs are arranged diagonally.

Further, upper ends of the long side ribs and the short side ribs are integrally formed and provided with upward convex raised strips.

Further, at least one ice cube tray body is arranged, the ice cube tray body includes a base plate and a plurality of columns of ice-making chambers which are integrally arranged in the base plate and in a downward concave shape, an outer edge of the base plate is provided with a small notch and a large notch, the small notch is matched with the second end ribs in use, and both ends of the large notch are clamped at two sides of the central rib and the first end rib that are arranged on the same side.

Further, a protruding support plate is arranged between the two columns of ice-making chambers near the end of the ice cube tray body, and the support plate is arranged in an arc shape low in two ends and high in the middle.

Further, an outer circle of an upper surface of the base plate is provided with a clamping groove which is in inserted matching with the raised strip.

Further, the quantity of the ice knocking columns is the same as the quantity of the ice-making chambers.

Further, an outward convex lift plate is arranged at a middle position of a length side of the cover body.

The present invention has reasonable structural design; position-limited placement of a plurality of layers of ice cube tray bodies can be realized through the rib assembly arranged on the inner wall of the box body; at the same time, through the raised strips arranged on top ends of the ribs and the clamping groove arranged on the base plate, ice cubes can be taken out conveniently by knocking the ice knocking columns after the ice cube tray body is inverted, which is convenient and quick for taking out ice, has no damage on the ice cube tray and prolongs the service life of the ice cube tray.

Where: 1—box body, 2—cover body, 3—ice cube tray body, 301—base plate, 302—ice-making chamber, 303—small notch, 304—large notch, 305—support plate, 306—clamping groove, 4—ice removing plate, 5—ice knocking column, 6—central rib, 7—first end rib, 8—second end rib, 9—raised strip and 10—lift plate.

DESCRIPTION OF THE EMBODIMENTS

The present invention is further illustrated by the following description in conjunction with the accompanying drawings.

The present invention discloses an ice cube tray box for facilitating ice making and ice removing. The ice cube tray box is provided with an ice cube tray box body 3 inside. The ice cube tray box body 3 changes a traditional way of taking out ice cubes by pressing with fingers, and realizes one-time taking-out of the ice cubes by arranging a cover body 2 with a special structure. In addition, when the ice cubes fall out, they completely fall inside the box body 1, so that the ice cubes are prevented from flying out.

Figure 1:
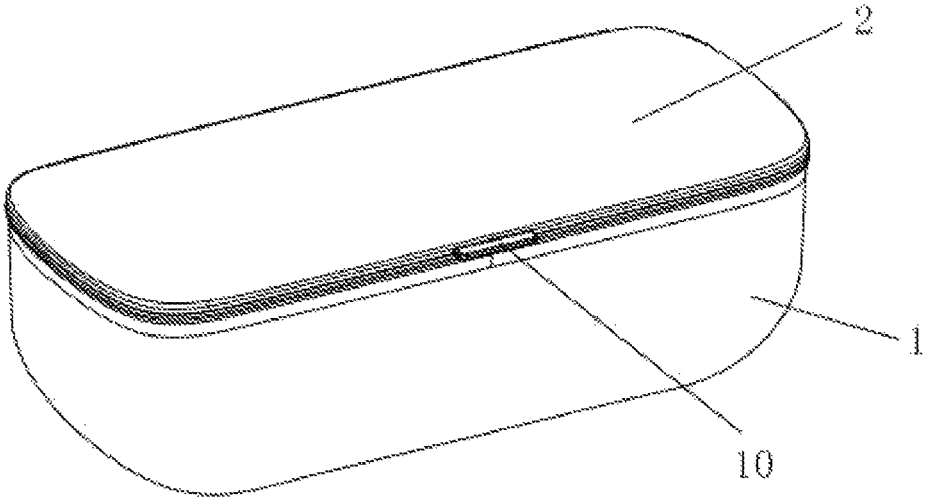
FIG. 1 is a schematic diagram of an overall structure of the present invention.
Figure 2:
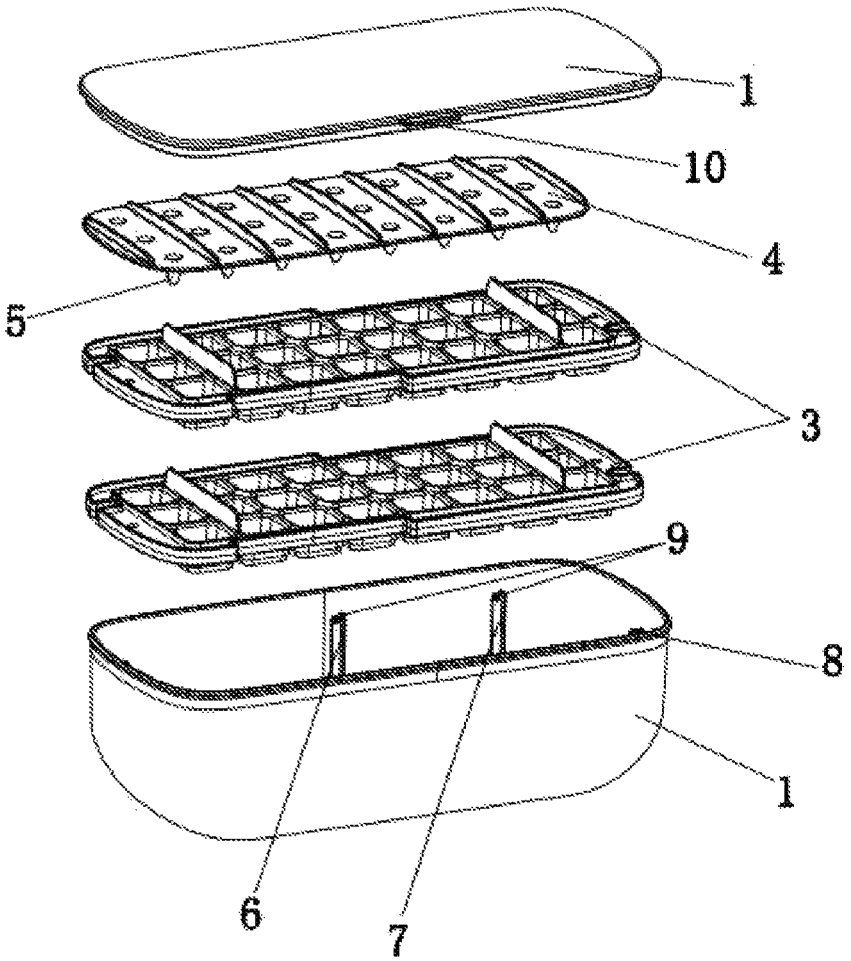
FIG. 2 is an explosive diagram of FIG. 1.
Figure 3:
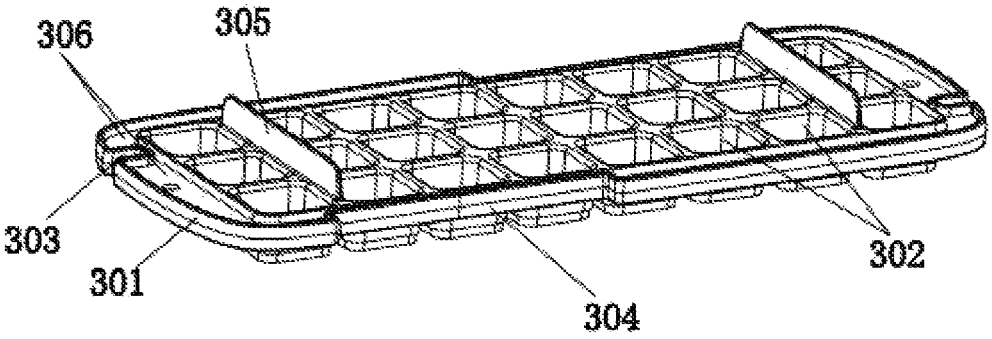
FIG. 3 is a schematic structural diagram of an ice cube tray body.

As shown in FIGS. 1-3, a specific structure of an ice cube tray box for facilitating ice making and ice removing includes a box body 1, a cover body 2 arranged at an open end of the box body 1, and an ice cube tray body 3 arranged inside the box body 1. At least one ice cube tray box body 3 is arranged, and the specific quantity can be selected according to the depth of the box body 1. To facilitate opening of the cover body 2, an outward convex lift plate 10 is arranged at a middle position of a length side of the cover body 2; a vertical upward rib assembly is arranged on an inner wall of the box body 1; a notch assembly matched with the rib assembly in use is arranged on an outer edge of the ice cube tray body 3; an ice removing plate 4 for facilitating ice removing is clamped and arranged on an inner side surface of the cover body 2; and ice knocking columns 5 are integrally arranged on the ice removing plate 4, and the quantity of the ice knocking columns 5 is the same as the quantity of the ice-making chambers 302.

Referring to FIGS. 2-3, the box body 1 is rectangular as a whole, short sides thereof are arranged in an arc shape, and the rib assembly includes long side ribs and short side ribs with the same structure. The long side ribs include two central ribs 6 and two first end ribs 7, the central ribs 6 are symmetrically arranged at center positions of the long sides of the box body 1, the first end ribs 7 are respectively arranged at end positions of the long sides of the box body 1, and the two first end ribs 7 are diagonally arranged. The short side ribs include two second end ribs 8, the two second end ribs 8 are respectively arranged on inner sides of the short sides of the box body 1 and are arranged far away from the side where the first end ribs 7 are located, and the two second end ribs 8 are arranged diagonally.

Referring to FIG. 3, the ice cube tray body 3 includes a base plate 301 and a plurality of columns of ice-making chambers 302 which are integrally arranged in the base plate 301 and in a downward concave shape. In order to match the use of the long side rib and the short side rib, an outer edge of the base plate 301 is provided with a small notch 303 and a large notch 304, the small notch 303 is matched with the second end ribs 8 in use, and both ends of the large notch 304 are clamped at two sides of the central rib 6 arranged on the same side and both sides of the first end rib 7. In order to facilitate inverted placement and then fixation of the ice cube tray body 3, upper ends of the long side ribs and the short side ribs are integrally formed and provided with upward convex raised strips 9. An outer circle of an upper surface of the base plate 301 is provided with a clamping groove 306 which is in inserted matching with the raised strip 9.

Referring to FIG. 3, a protruding support plate 305 is arranged between the two columns of ice-making chambers 302 near the end of the ice cube tray body 3, and the support plate 305 is arranged in an arc shape low in two ends and high in the middle. The support plate 305 is arranged, so that when the multi-layer ice cube tray bodies 3 are stacked up and down, the support plate 305 on the lower-layer ice cube tray body 3 is inserted into the gap at the bottom of the previous ice cube tray body 3. Because the support plate 305 is high in the middle and low in both ends, a gap is left between the connected ice cube tray bodies 3 when the ice cube tray bodies 3 are stacked up and down.

During ice making with the present invention, the ice-making chambers 302 are filled with water; the ice cube tray body 3 filled with water is put into the box body 1 through the notches and the rib assembly; and the cover body 2 is covered. After ice cubes are made, the cover body 2 is opened; the ice cube body 3 is inverted; the ice cube body 3 is fixed by the raised strip 9 and the clamping groove 306; and then the cover body 2 is covered and the cover body 2 is pressed horizontally, so that the ice knocking columns 5 on the ice removing plate 4 exerts certain vibration force to the ice-making chambers 302. In this way, the ice cubes fall into the box body 1, and the ice removing process is completed. The ice removing process is convenient and quick.

What is claimed is:

1. An ice cube tray box for facilitating ice making and ice removing, comprising a box body, a cover body arranged at an open end of the box body, and an ice cube tray body arranged inside the box body, wherein a vertical upward rib assembly is arranged on an inner wall of the box body, a notch assembly matched with the rib assembly in use is arranged on an outer edge of the ice cube tray body, an ice removing plate for facilitating ice removing is clamped and arranged on an inner side surface of the cover body, and ice knocking columns are integrally arranged on the ice removing plate.

2. The ice cube tray box for facilitating ice making and ice removing according to claim 1, wherein the box body is rectangular as a whole, short sides thereof are arranged in an arc shape, and the rib assembly comprises long side ribs and short side ribs with the same structure.

3. The ice cube tray box for facilitating ice making and ice removing according to claim 2, wherein the long side ribs comprise two central ribs and two first end ribs, the central ribs are symmetrically arranged at center positions of long sides of the box body, the two first end ribs are respectively arranged at end positions of the long sides of the box body, and the two first end ribs are diagonally arranged.

4. The ice cube tray box for facilitating ice making and ice removing according to claim 2, wherein the short side ribs comprise two second end ribs, the two second end ribs are respectively arranged on inner sides of the short sides of the box body and are arranged far away from the side where the first end ribs are located, and the two second end ribs are arranged diagonally.

5. The ice cube tray box for facilitating ice making and ice removing according to claim 2, wherein upper ends of the long side ribs and the short side ribs are integrally formed and provided with upward convex raised strips.

6. The ice cube tray box for facilitating ice making and ice removing according to claim 1, wherein at least one ice cube tray body is arranged, the ice cube tray body comprises a base plate and a plurality of columns of ice-making chambers which are integrally arranged in the base plate and in a downward concave shape, an outer edge of the base plate is provided with a small notch and a large notch, the small notch is matched with the second end ribs in use, and both ends of the large notch are clamped at two sides of the central rib and the first end rib that are arranged on the same side.

7. The ice cube tray box for facilitating ice making and ice removing according to claim 6, wherein a protruding support plate is arranged between the two columns of ice-making chambers near an end of the ice cube tray body, and the support plate is arranged in an arc shape low in two ends and high in the middle.

8. The ice cube tray box for facilitating ice making and ice removing according to claim 6, wherein an outer circle of an upper surface of the base plate is provided with a clamping groove which is in inserted matching with the raised strip.

9. The ice cube tray box for facilitating ice making and ice removing according to claim 6, wherein a quantity of the ice knocking columns is the same as a quantity of the ice-making chambers.

10. The ice cube tray box for facilitating ice making and ice removing according to claim 1, wherein an outward convex lift plate is arranged at a middle position of a length side of the cover body.

* * * * *